US005836717A

United States Patent [19]

Bernini

[11] Patent Number: 5,836,717

[45] Date of Patent: Nov. 17, 1998

[54] MULTI-SEGMENT SPANDREL WALL FOR OVERFILLED ARCH STRUCTURES

[75] Inventor: Joe Bernini, Binz, Switzerland

[73] Assignee: Bebo of America, Montgomery, Ala.

[21] Appl. No.: 806,113

[22] Filed: Feb. 25, 1997

[51] Int. Cl.[6] ..... E01F 5/00

[52] U.S. Cl. ..... 405/125; 52/88; 405/124

[58] Field of Search ..... 405/124, 125, 405/126, 127; 52/86, 88

[56] References Cited

U.S. PATENT DOCUMENTS

| | | | |
|---|---|---|---|
| 494,576 | 4/1893 | Lewis . | |
| 546,245 | 9/1895 | Parker . | |
| 567,563 | 9/1896 | Butterfield . | |
| 597,590 | 1/1898 | Pratt | 405/124 X |
| 786,059 | 3/1905 | Simpson | 405/125 |
| 820,342 | 5/1906 | Besser . | |
| 884,072 | 4/1908 | Carey | 405/125 |
| 997,382 | 7/1911 | Foster | 405/125 |
| 1,213,916 | 1/1917 | Souder | 405/126 X |
| 4,854,775 | 8/1989 | Lockwood | 405/124 X |

*Primary Examiner*—Dennis L. Taylor
*Attorney, Agent, or Firm*—Terry M. Gernstein

[57] ABSTRACT

An overfilled arch structure includes a spandrel wall that is formed of a plurality of separate segments, each of which is monolithic. The arch structure includes an arch end element having a curb thereon at one end edge, and the segments of the spandrel wall each have a front face that is in abutting contact with the curb and a rear face that is exposed to earth backfill. Vertical support for the segments is provided by the arch end element and the foundation and horizontal support is provided by the curb and the wingwalls. Stabilization is provided by the earth backfill. The lateral segments of the spandrel walls are mirror images of each other and can be formed in a single form. A joining spandrel segment is identical to two lateral segments in edge-to-edge relationship and is used for side-by-side structures. A central segment, like the lateral segments, has at least one arcuate side for snugly abut against the arch element, and can have two arcuate sides.

29 Claims, 15 Drawing Sheets

FIG. 8.
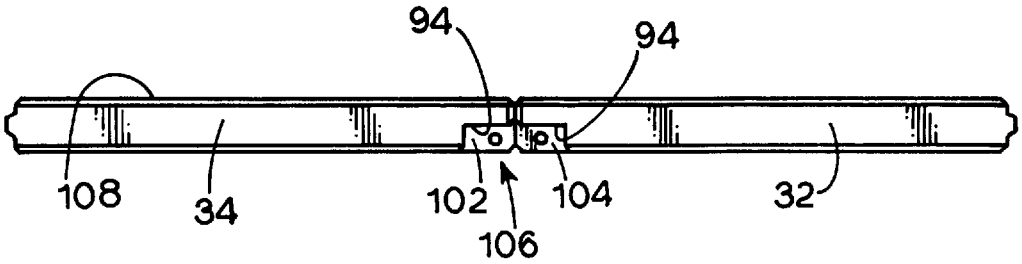
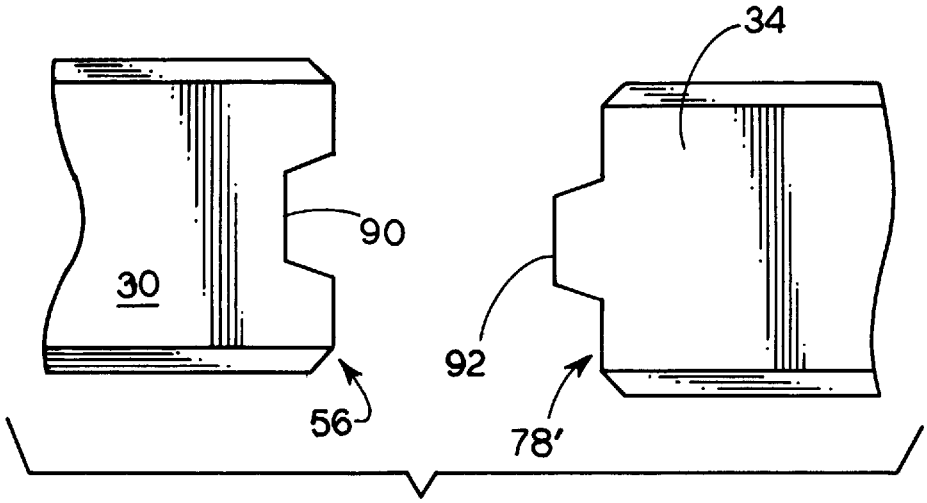
FIG. 9.

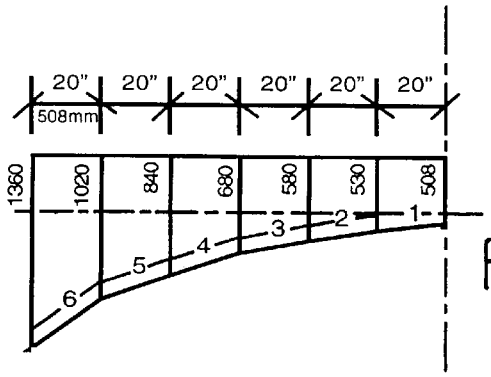
FIG. 12.
FIG. 13A.
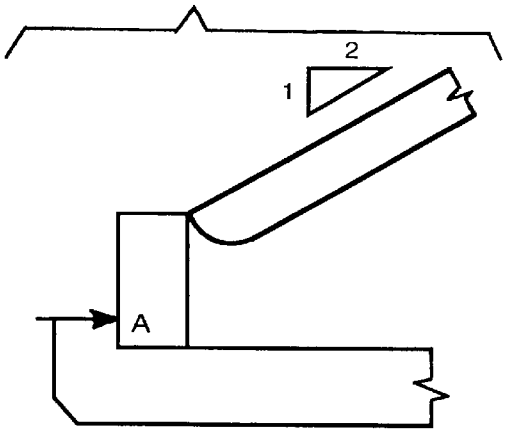
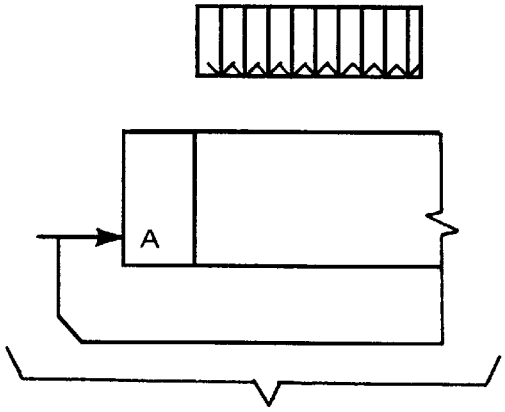
FIG. 13B.
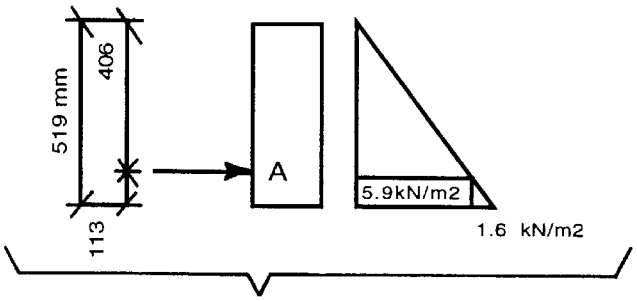
FIG. 14A

MULTI-SEGMENT SPANDREL WALL FOR OVERFILLED ARCH STRUCTURES

TECHNICAL FIELD OF THE INVENTION

The present invention relates to the general art of structural environment, hydraulic engineering and geotechnical engineering, and to the particular field of overfilled arch structures.

BACKGROUND OF THE INVENTION

In the field of civil engineering, bridges, underpasses and load support structures such as disclosed in U.S. Pat. No. 3,482,406, are often pre-cast and are overfilled in situ. These structures can be an arch, which has an open bottom and interacts with the soil via deformation due to loading, as opposed to a culvert, such as disclosed in U.S. Pat. No. 546,245, which is closed and generally hardly interacts with the soil loaded thereon. The present invention is concerned with arches as opposed to culverts. As used herein, the term "arch structure" refers to an overall structure formed of one or more arch elements. An arch structure such as disclosed in the aforementioned U.S. Pat. No. 3,482,406 patent, has several arch elements as well as spandrel walls and wing walls resting on a foundation and stabilized by earth overfill.

An overfilled arch structure generally includes spandrel, or end, walls. As shown in FIG. 1, the prior art spandrel walls are one-piece monolithic elements that are often pre-cast and shipped to a site for erection and are attached to an arch element by metal ties. As can be understood from FIGS. 1 and 1A, the prior art spandrel walls are supported vertically by the foundations and horizontally by the ties and the wingwalls.

The ties have several drawbacks and problems. For example, these ties are generally stainless steel, and thus are expensive to purchase. These ties must be monitored and may require maintenance because they are generally buried and subject to environmental factors.

In addition to the problems associated with the ties, the handling and shipping of a monolithic precast concrete spandrel wall weighing several thousand pounds can be difficult and expensive.

Therefore, there is a need for a precast concrete spandrel wall which is used in conjunction with an overfilled arch structure and which can be efficiently shipped and erected and does not need metal ties that require monitoring and maintenance.

OBJECTS OF THE INVENTION

It is a main object of the present invention to provide a precast concrete spandrel wall that is easily erected.

It is another object of the present invention to provide a precast concrete spandrel wall that is easily shipped.

It is another object of the present invention to provide a precast concrete spandrel wall that eliminates the need for metal, or any, ties between the arch element and the spandrel wall.

SUMMARY OF THE INVENTION

These, and other, objects are achieved by a multi-segment spandrel wall which is supported by a specially formed arch end element. The arch end element has a curb thereon at one end thereof and the spandrel wall segments abut the curb. Vertical support for the spandrel wall segments is provided by the arch end element and the foundations and horizontal support for the spandrel wall segments is provided by the curb and the wingwalls. The earth backfill provides stability.

Specifically, one form of the segmental spandrel wall of the present invention includes three spandrel segments, a center segment and two lateral segments. For smaller arch structures, only two lateral segments that but at the arch center can be used; the structural behavior of a two-segment spandrel wall is analogous to the one of a three-segment spandrel wall and need not be described as one skilled in the art will understand this behavior based on the teaching of this disclosure. The three segments rest on a special arch end element that includes a curb, providing horizontal support for the spandrel segments. The lateral segments are also further supported by wingwalls. Vertical support is provided by the arch end element and the foundation, with the arch end element providing all of the vertical support for the center segment. The curb provides essentially all of the horizontal support for the center segment, while the lateral segments are horizontally supported both by the curb and the wingwall. The height of the curb element can be selected so that the overturning moment acting on the centermost section of the center segment is greater than the positive moment acting on this centermost section, with the positive moments acting on the outermost sections of the center segment more than offsetting this. The segmented spandrel wall attains its final stability once the structure is back- and overfilled.

The spandrel segments have to transmit compressive forces only; so other than temporary connections between spandrel segments and wingwalls or between the spandrel segments and the arch end element are not required and thus can be omitted.

Another form of the invention is adapted for use with multiple arch structures and includes a joining segment. Horizontally, the joining segment is solely supported by the curbs on the two side-by-side arch end elements. Vertical support is provided by the arch end elements and the pier foundation. As before, final stability is achieved through backfill.

Using a curb element on an arch element to provide horizontal support to the spandrel wall eliminates the ties used in the prior art and the problems associated with those ties. Furthermore, using a multisegment spandrel wall substantially improves the versatility of the wall as well as makes manufacture, shipping and erection substantially easier than is the case with the prior art one-piece monolithic spandrel walls.

BRIEF DESCRIPTION OF THE DRAWING FIGURES

FIG. 8 is a top view of the lateral segments shown in FIG. 7.

FIG. 9 shows two adjacent segments and a means for coupling these two elements together.

FIG. 12 shows one-half of a center segment divided into a plurality of portions for the purpose of illustrating overturning moments acting thereon.

FIGS. 13A and 13B illustrate two loading conditions acting on the center segment.

FIGS. 14A through 14F illustrate the moments acting on each portion of the center segment under the first loadcase.

DETAILED DESCRIPTION OF THE PREFERRED EMBODIMENT OF THE INVENTION

Figure 1:
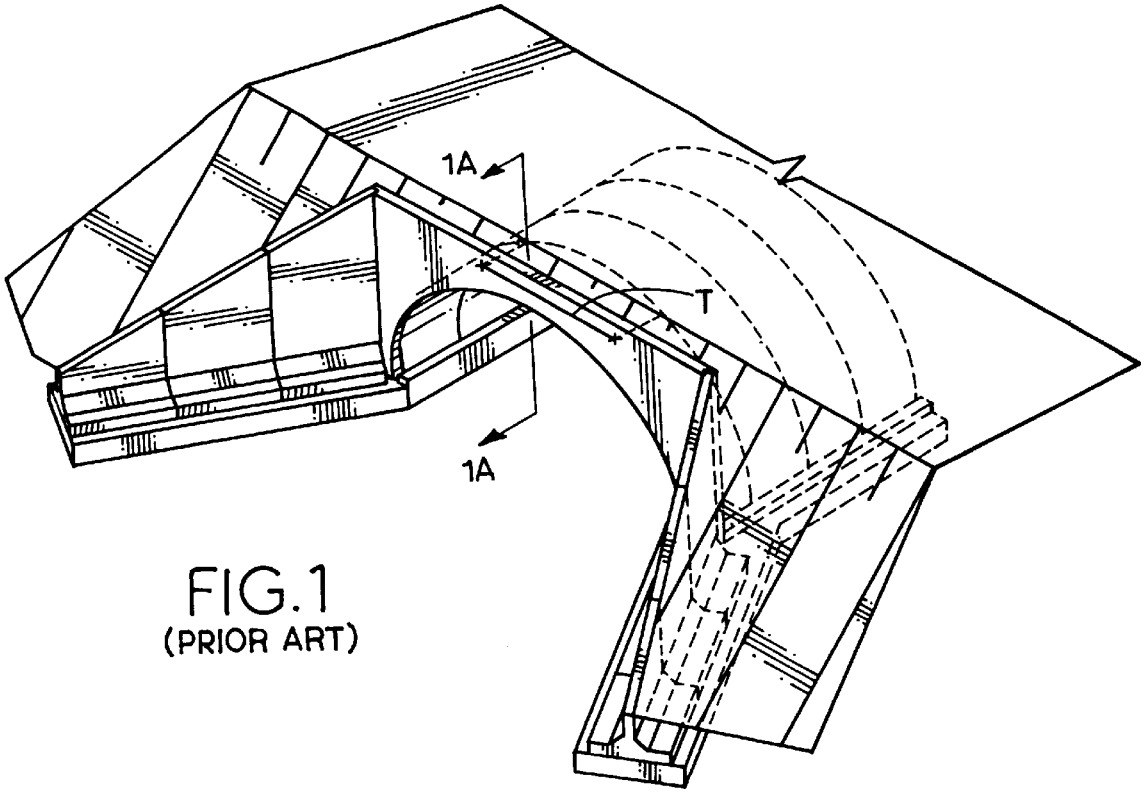
FIG.1 (PRIOR ART)
FIG. 1 is a perspective view of a prior art structure.
Figure 1A:
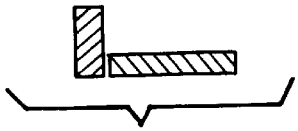
FIG.1A. (PRIOR ART)
FIG. 1A is a view of the prior art structure taken along line 1A—1A in FIG. 1.

Shown in FIG. 1 is a prior art structure which includes ties, or tieback elements T to connect the spandrel wall to the arch element A. As can be best seen in FIG. 1A, arch element A has no curb or any other means for horizontally supporting the spandrel wall; therefore, the ties T are needed.

Shown in FIGS. 2 through 4C is an earth overfilled arch structure 10 which includes a foundation 12 supporting a plurality of curved arch elements, such as element 14 and arch end element 16, as well as wingwalls 18, that can include a plurality of segments, such as wingwall segment 20. Earth backfill 22 is also included to stabilize the structure.

With regard to the present invention, structure 10 includes a multisegment spandrel wall 26 supported on arch end element 16. Spandrel wall 26 includes a plurality of segments which can be formed and/or shipped and/or erected separately. Each segment of spandrel wall 26 is a one-piece monolithic unit in and of itself and can be totally independent of the other segments of the spandrel wall. Thus, spandrel wall 26 is a multisegment wall as opposed to a one-piece monolithic wall of the prior art. Each segment of wall 26 is one-piece monolithic however.

Specifically, spandrel wall 26 includes a center segment 30 and two lateral segments 32 and 34. Lateral segments 32 and 34 are mirror images of each other whereby they can be formed in a single form as will be understood from the following disclosure. As can best be seen in FIGS. 4 through 4C, arch end element 16 includes a curb 36 located at end edge 38 thereof, with the other end edge 38' thereof, adapted to abut an adjacent arch element, such as element 17 in a manner necessary to build overall structure 10. Curb element 36 extends upwardly from outer surface 40 of the arch element and has a top end edge 42 as well as a front surface 44 and a rear surface 46. Front surface 44 forms the end edge 38 of arch end element 16, and outer surface 40 extends for essentially the entire length of the arch end element from adjacent to rear surface 46 of the curb element to end 38'. The curb element has a height H measured between surface 40 and top edge 42 and a thickness T measured between surfaces 44 and 46. Curb element 36 is cast as part of the arch end element so arch end element 16, including curb element 36, is a monolithic element. Generally, arch element 16 is precast concrete. The form used for casting prior art arch elements needs to be modified only slightly to form the curb element as will occur to those skilled in the art based on the teaching of the disclosure herein. In the preferred form of the invention, curb element 36 extends for the entire distance of the outer end edge of arch element 16 to extend from one foot 50 of the arch element to the other foot 52 of the arch element.

Figure 2:
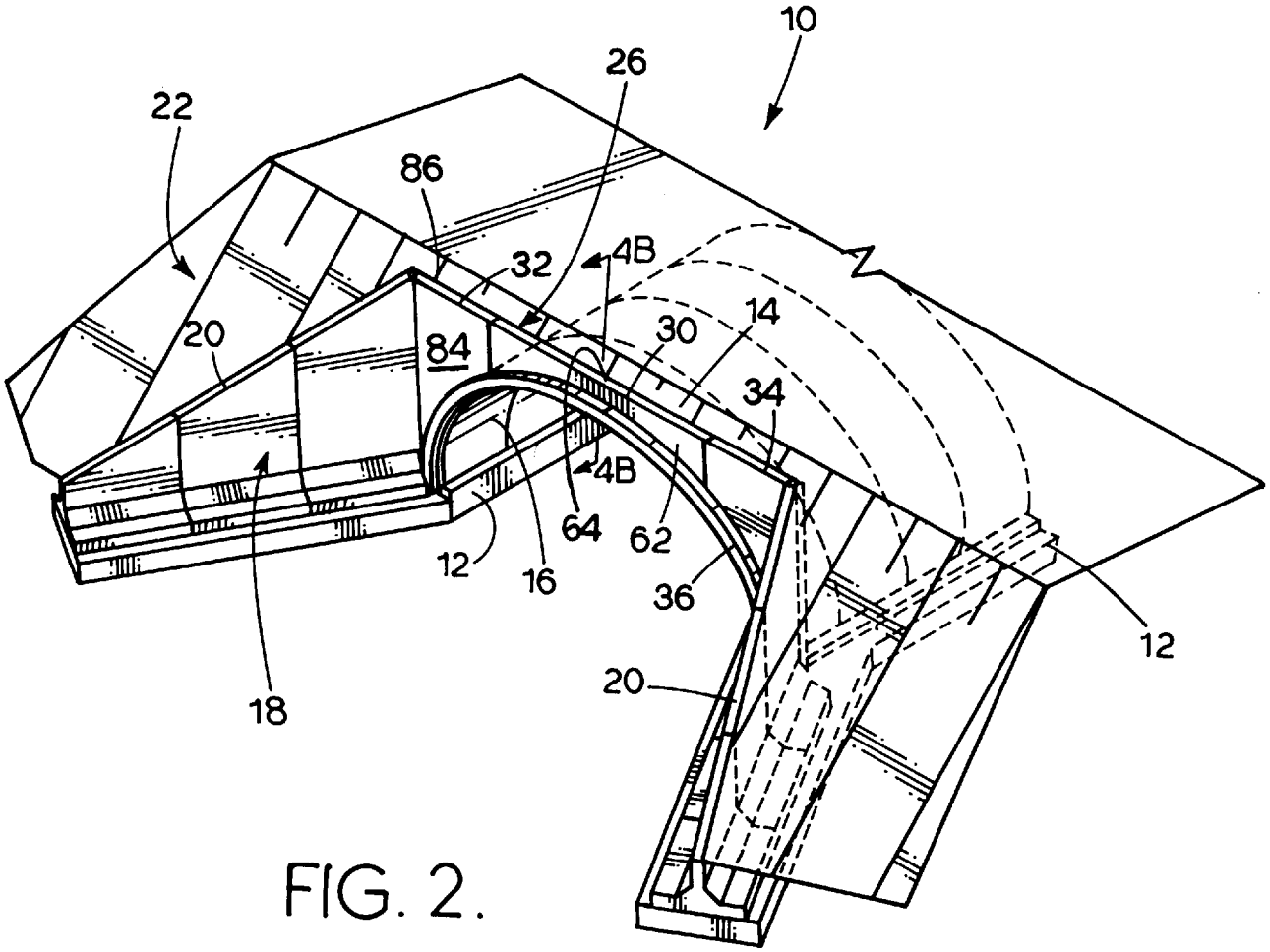
FIG. 2 is a perspective view of a multisegment spandrel wall embodying the present invention in an overfilled arch structure.
Figure 3:
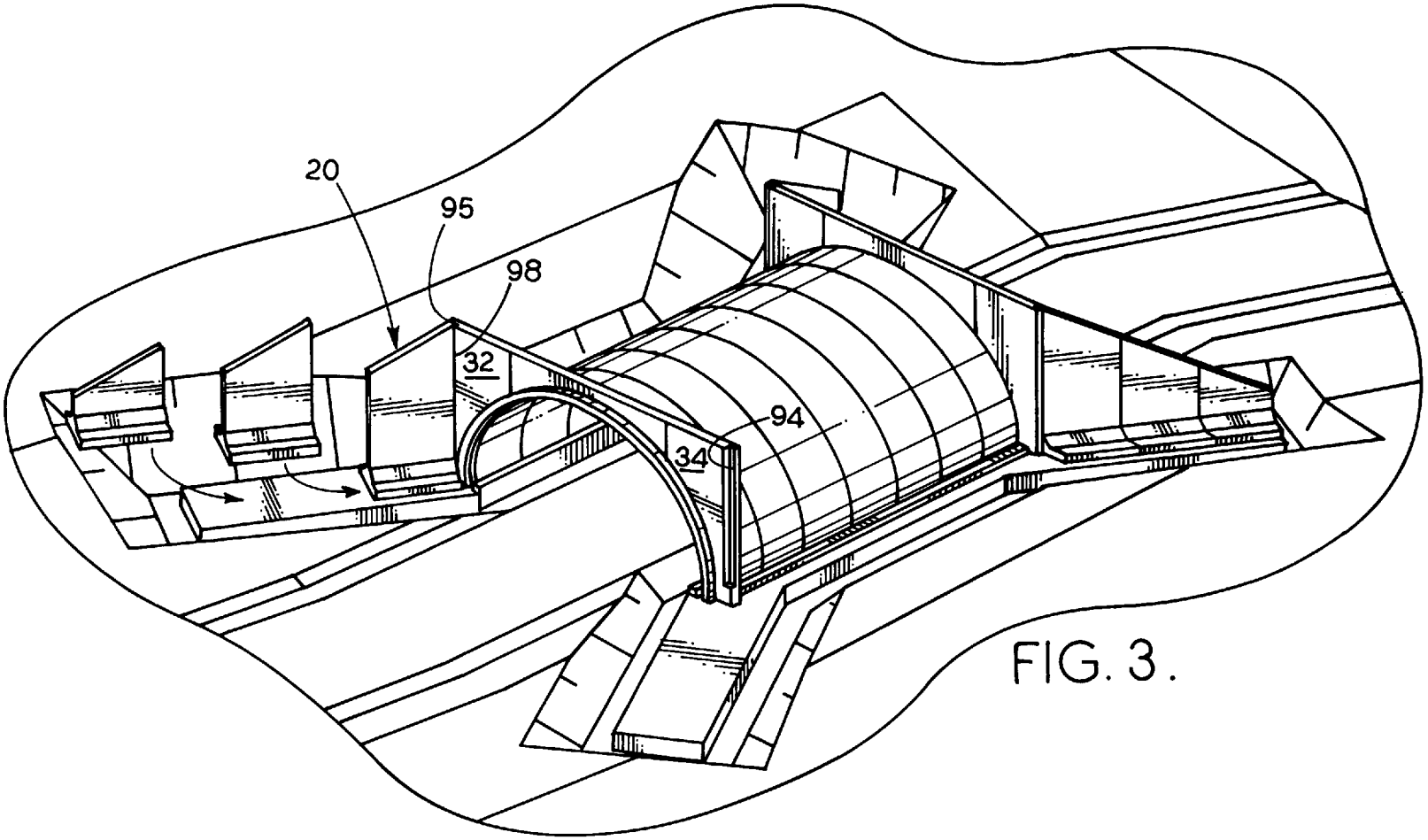
FIG. 3 is an exploded perspective showing an overfilled arch structure embodying the teaching of the present invention.
Figure 5:
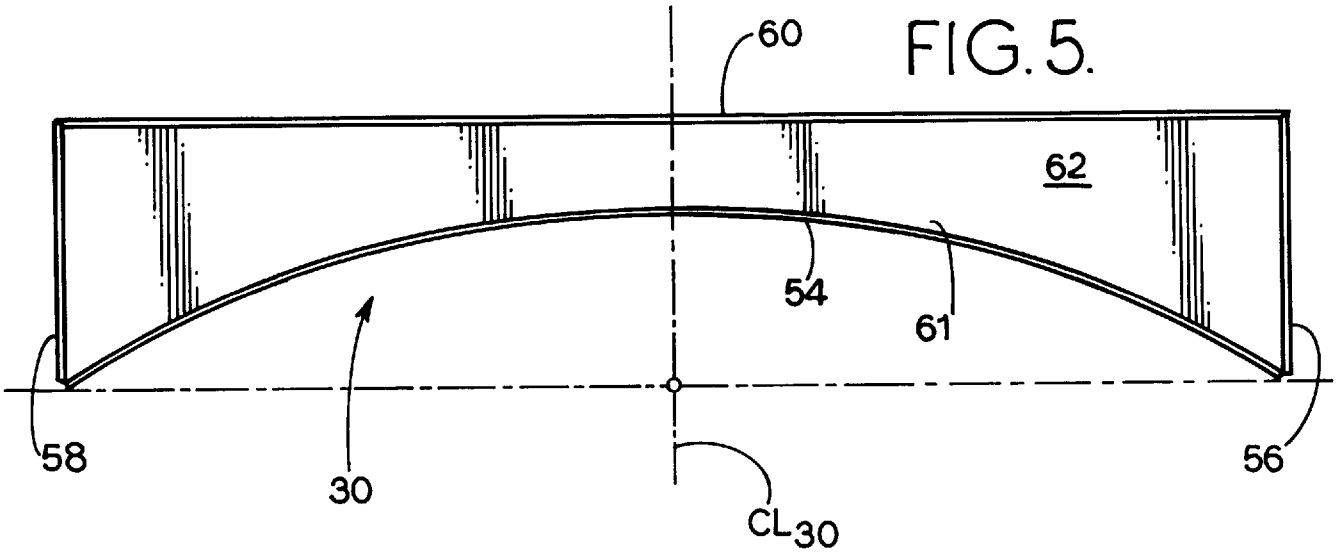
FIG. 5 is a front elevational view of a center segment of the multisegment spandrel wall of the present invention, the rear elevational view being identical to the front view.
Figure 6:
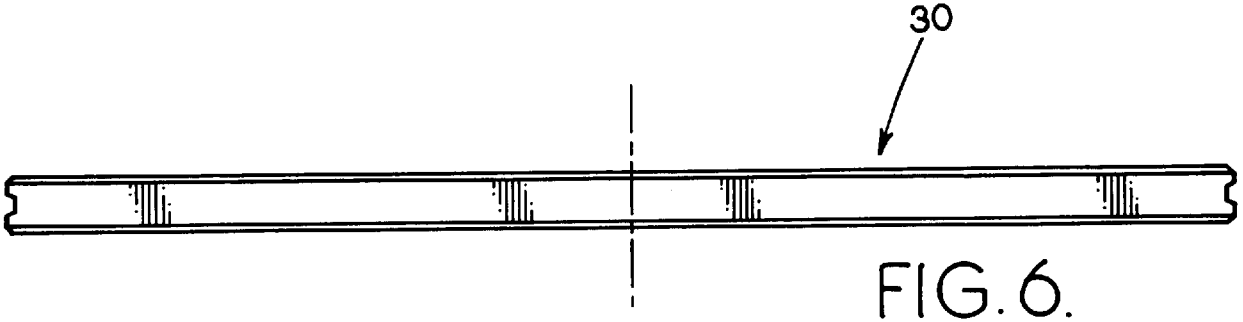
FIG. 6 is a top view of a center segment of the multisegment spandrel wall of the present invention.

The segments of the spandrel wall, such as center segment 30 and lateral segments 32 and 34 abut the curb as shown in FIGS. 2 and 3. Center segment 30 is best shown in FIGS. 5 and 6 and includes an arcuate edge 54 having a curvature matching the curvature of arch end element 16 whereby center segment 30 will rest stably on the arch end element. As can be understood from FIG. 4, the arch element forms the entire vertical support for the center segment, and the curb forms essentially the entire horizontal support for the center segment so the above-mentioned ties needed in the prior art are not needed for the structure of this invention. The center segment also includes two linear side edges 56 and 58 and a linear top edge 60. One form of the center segment has a width as measured between edges 54 and 60 that varies from approximately twenty inches at its narrowest location on centerline $CL_{30}$ to approximately 53 adjacent to side edges 56 and 58. As can be seen, the width of the center segment is smallest at the centerline $CL_{30}$. In the case just described, curb height H needs to be only four and one-half inches to adequately support the spandrel wall with a sufficient safety factor because the overturning moment applied to the center segment is a summation of the overturning moment applied to each section of the center segment. Thus, even though the overturning moment, that is the force applied to the center segment that tends to tip that segment over end edge 38, on the section of the center segment closest to centerline $CL_{30}$ is greater than the forces tending to prevent such tipping at that location, since the center segment is a one-piece monolithic element, the total forces acting thereon are a summation of the forces and moments acting on any section thereof. As will be discussed below with regard to FIGS. 12–15F, a force analysis on the center section reveals that this summation, when the sections adjacent to sides 56 and 58 are summed into the overall relationship, is well within a safety factor that prevents the overturning of the spandrel wall or any segment thereof even though the curb is twenty percent of the height of the narrowest section of the center segment. This same size curb will support the lateral sections as well. Curb 36 abuts center segment 30 adjacent to side 54 in area 61 on front surface 62, with the rear surface 64 (not shown in FIG. 5, see FIG. 2) being exposed to earth overfill 22.

The lateral segments are best shown in FIGS. 7, 7A, 7B and 8. As mentioned above, the lateral segments 32 and 34 are mirror images of each other and are both L-shaped. Since the lateral segments are mirror images, only segment 32 will be discussed. Segment 32 includes a bottom end 70 and a top end 72 connected by linear side 74 and side 76 which includes a linear portion 78 and an arcuate portion 80. Arcuate portion 80 has a curvature that matches that of the arch end element whereby the lateral segment fits snugly against the arch end element. The curb 36 abuts lateral segment 32 adjacent to arcuate side 80 in area 82. Lateral segment 32 includes a front surface 84 which is abutted by the curb, and a rear surface 86 (see FIG. 2) that is exposed to earth backfill 22. As can be understood from FIG. 4, vertical support for the lateral segments is provided by the arch element and the foundation, as indicated by arrow V, and horizontal support for the lateral segments is provided by the curb, as indicated by arrow H. Due to the abutting contact between the curb and the lateral segments, the lateral segments need not be tied to the arch element by ties such as is the case with the prior art.

Figure 7:
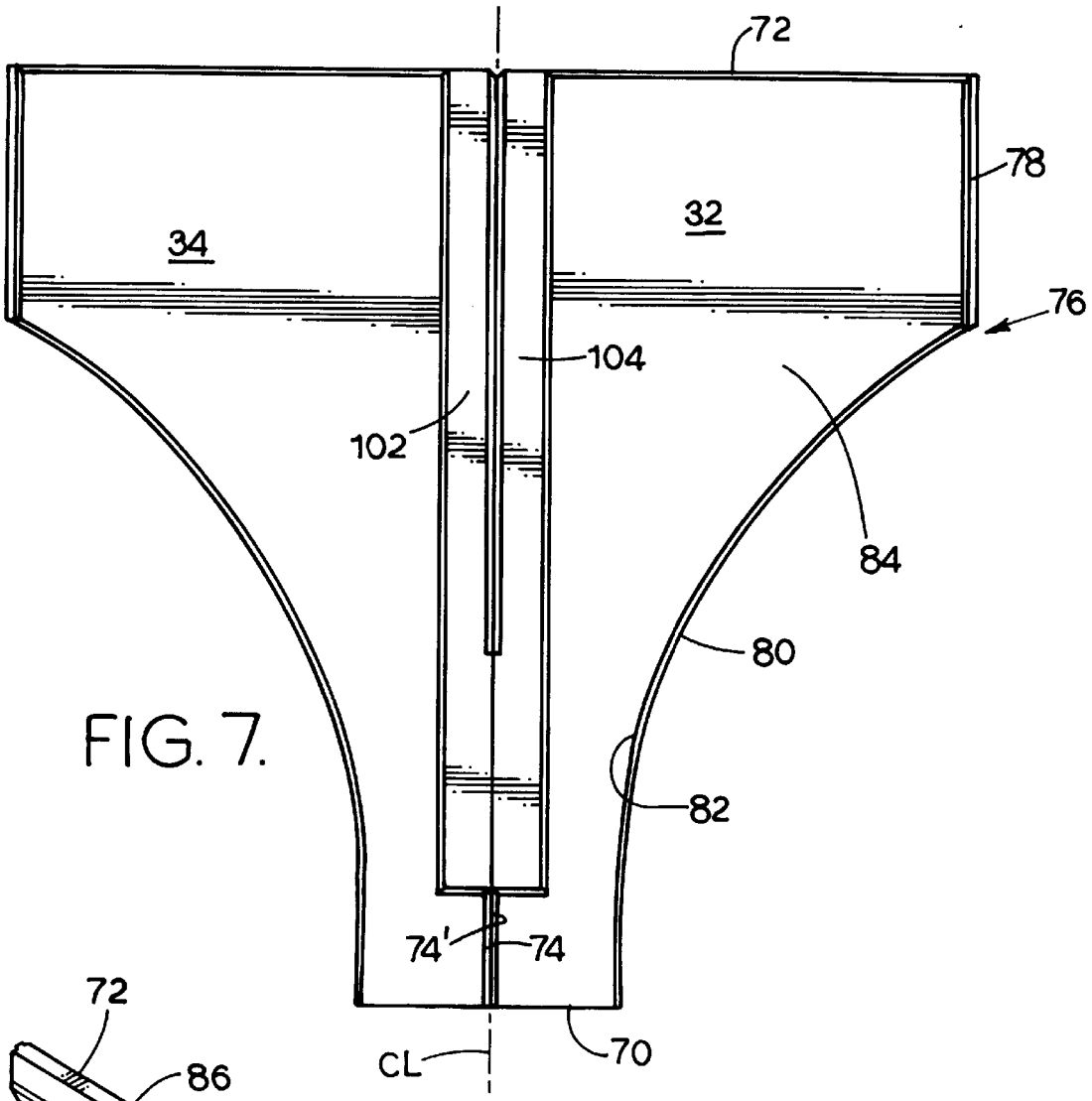
FIG. 7 is a front elevational view of two lateral segments or one joining segment, the rear view is identical to the front view.

Since the lateral segments are mirror images of each other, they can be formed in a single form that is roughly T-shaped as shown in FIG. 7. The form can be divided in the middle along centerline CL whereby one-half of the form forms segment 32 and the other half forms segment 34. If one single segment is desired, as will be discussed below, the division is omitted and one single T-shaped segment is formed. This feature provides versatility to the spandrel wall of the present invention.

Figure 4:
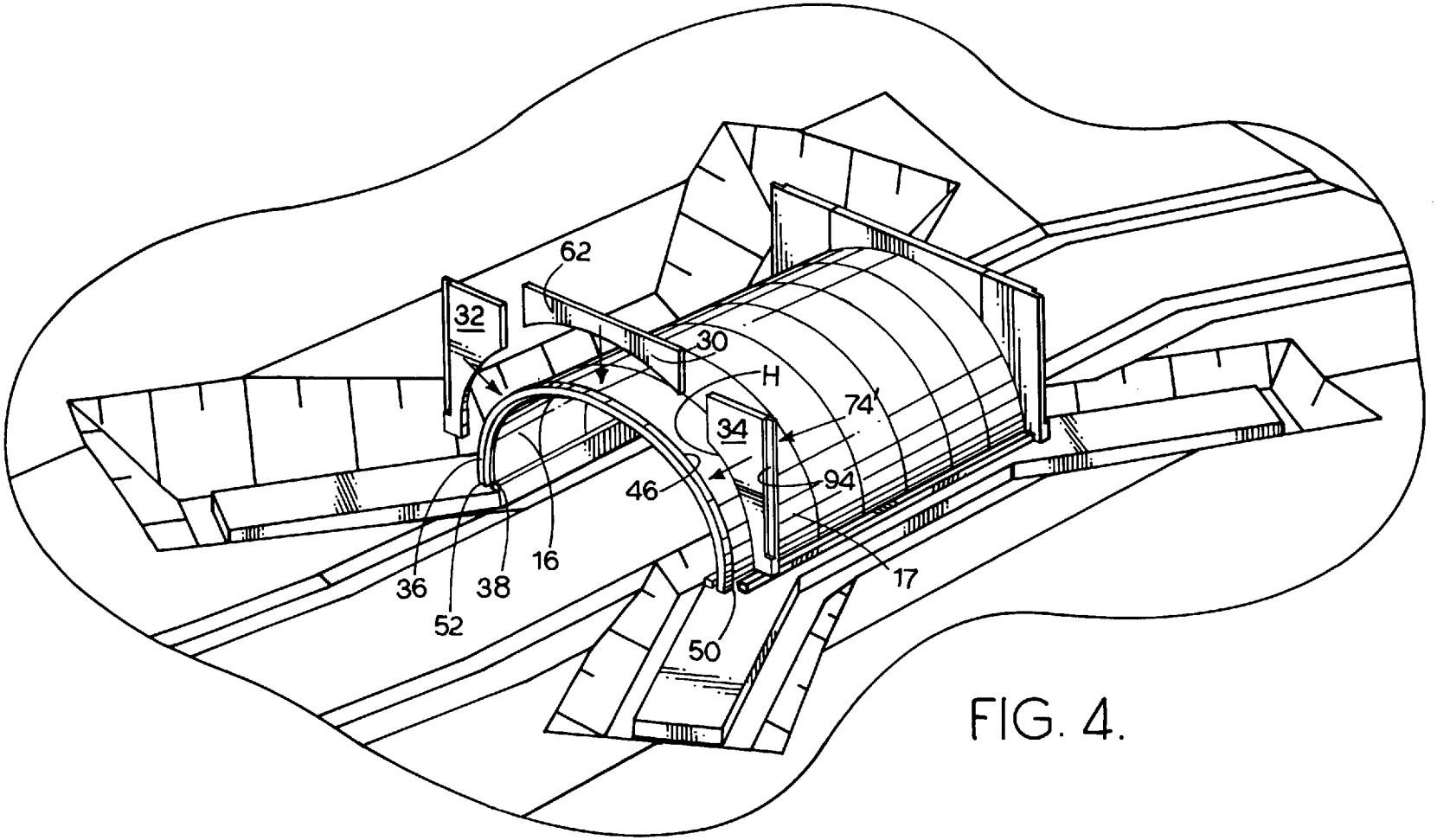
FIG. 4 is another exploded perspective of the overfilled arch structure embodying the present invention.
Figure 4A:
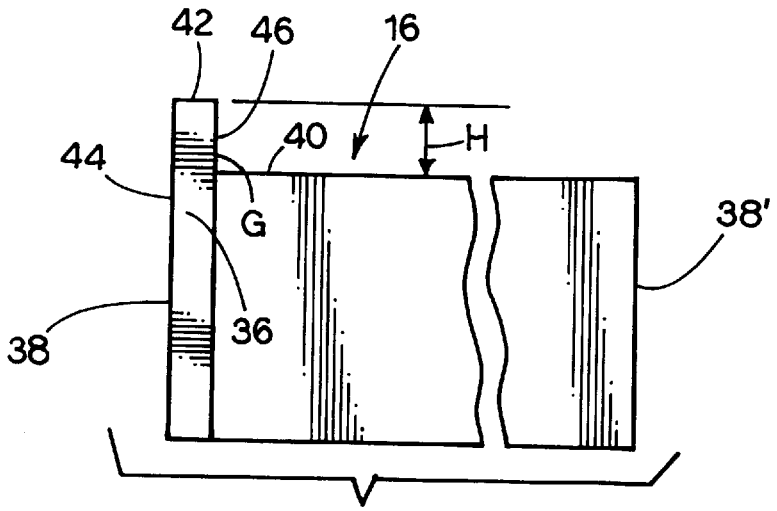
FIG. 4A is a side elevational view of a pre-cast concrete, one-piece monolithic curved arch end element showing the curb thereon at one end edge thereof.
Figure 4B:
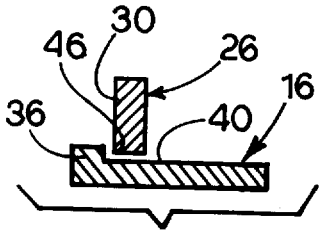
FIG. 4B is a section through the arch end element showing the curb and the spandrel wall of the present invention.
Figure 4C:
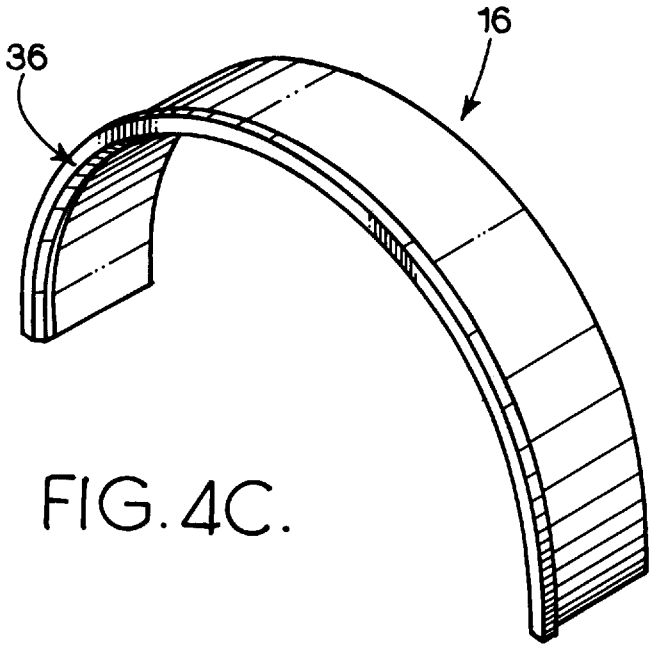
FIG. 4C is a perspective view of the arch end element of the present invention.

Erection of the spandrel wall is indicated in FIG. 4. After the arch elements, including arch end element 16, have been positioned, central segment 30 is placed on arch end element 16 with front surface 62 abutting the curb rear surface 46, then the lateral segments 32 and 34 are placed on the arch end element 16 with the front surfaces thereof in abutting contact with the rear surface of the curb. For safety reasons, lateral segments 32 and 34 need to be fixed to the arch end element by some means such as adhesive G (see FIG. 4A). This means is only temporary until the backfill is added so the means can deteriorate over time and need not be monitored. Once the spandrel wall segments are in the desired position on arch element 16, the wingwalls 20 are placed and abut the lateral segments adjacent to their outer end edges as shown in FIG. 2 and support them horizontally. In order to guarantee a linear abutting contact between the lateral segments and the wingwalls, some temporary means is used to tie them together. As the spandrel wall in turn also supports the wingwall, abutting contact between the central segment and the lateral segments is also needed.

To further stabilize the spandrel wall, the end edges of the segments can include means for coupling the segments to adjacent elements. Thus, shown in FIG. 9, center segment 30 has a groove 90 defined lengthwise thereof in end 56 and lateral segment 34 has a projection 92 on end 78' thereof to extend the total length of end section 78'. Projection 92 is received in groove 90 to couple lateral segment 34 to center segment 30. Similar and corresponding coupling means are on the other end edge of the center segment and on the other lateral segment 32 whereby the center segment is coupled to both lateral segments.

Figure 7A:
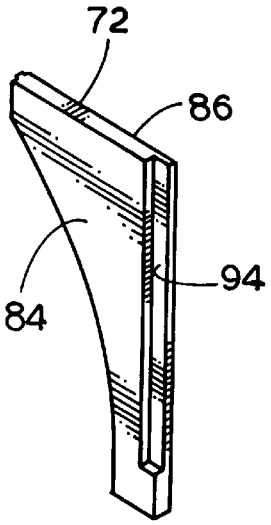
FIG. 7A is a perspective view of one of the lateral segments.
Figure 7B:
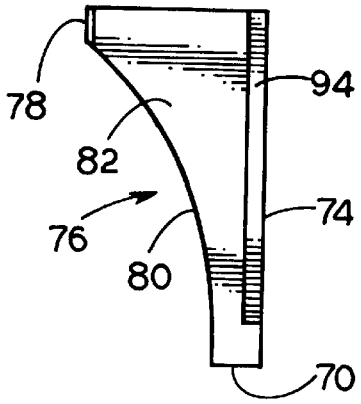
FIG. 7B is a front elevational view of a lateral segment.

A coupling means is also on the lateral segments for coupling each of the lateral segments to a corresponding wingwall. Thus, as shown in FIGS. 4, 7A and 7B, lateral segment 34 includes a groove 94 that extends for a portion or the whole of the length of side 74' (see also, FIGS. 7 and 8). As shown in FIG. 3, proximal end 98 of wingwall 20 abuts this groove in the corresponding lateral segment 32. The wingwall includes a projection 95 that engages groove 94 if desired.

Thus, in the finished structure, vertical support for the center and lateral segments is provided by the arch element 16 and foundation 12, and horizontal support is provided by the curb 36 and the wingwalls 20 with the back fill and coupling means providing stability to the spandrel wall, and the ties needed in prior art walls are not necessary. Also, as was discussed above, vertical support for the center segment is entirely provided by the arch element as can be understood by reference to FIG. 2–4B, and horizontal support for the center segment is essentially entirely provided by the curb. Some additional horizontal support for the center segment can be provided under some conditions when desired by the contact between the center segment and the lateral segments, but this is not absolutely necessary. However, under any configuration, the ties needed in the prior art are not needed for the structure of the present invention.

Figure 10:
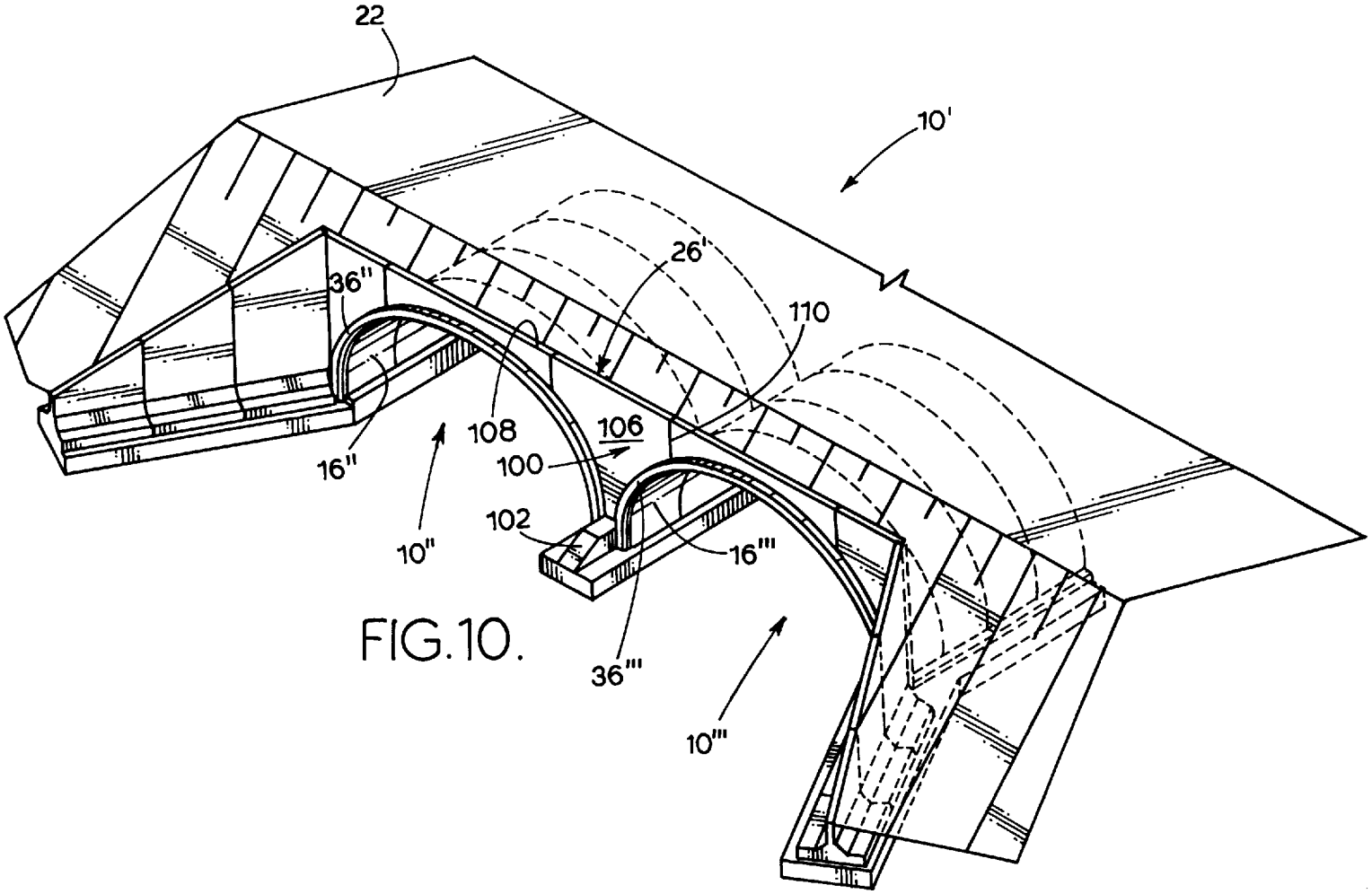
FIG. 10 is a perspective view of two side-by-side structures embodying another form of the present invention.

As above discussed, certain conditions generate requirements for a variety of shapes for the arch structures. One such variation is a side-by-side structure 10' shown in FIG. 10 with two structures 10" and 10'" extending side-by-side and parallel to each other. A single spandrel wall 26' includes two center segments 30, that are identical to each other and to the above-described center segment 30, and three lateral segments: segment 32, segment 34, which are identical to the above-described lateral segments 32 and 34, and a joining spandrel segment 100 on a central foundation 102. Each of the central and lateral segments of structure 10' are identical to the above-described corresponding segments and thus will not be discussed again. As can be seen from FIG. 7, the combined L-shapes of lateral segments 32 and 34 define a T-shape for joining spandrel segment 100. Therefore, lateral segments and joining segments can be formed in a single form, using a division and form blocks 102 and 104 for forming lateral segments 32 and 34. As can be seen in FIG. 10, joining spandrel segment 100 includes two arcuate sides each of which snugly fits against the outside surface of a corresponding arch end element 16" and 16'", while the joining spandrel segment also includes two linear sides 110 which correspond to sides 78 described above and which abut the sides of the central segment as above described. Coupling means are included in the sides 110 and the sides of the central segment to couple the joining spandrel segment to the central segments of structures 10" and 10'" in the manner described above. Structure 10' is assembled and erected in a manner similar to that described above with reference to structure 10, and thus will not be described again. As with structure 10, the spandrel wall 26' is supported vertically by the arch elements 16" and 16'" and the foundations and horizontally by the curbs 36" and 36'" on each of those arch elements respectively and the wingwalls, with the backfill providing stability.

Figure 11:
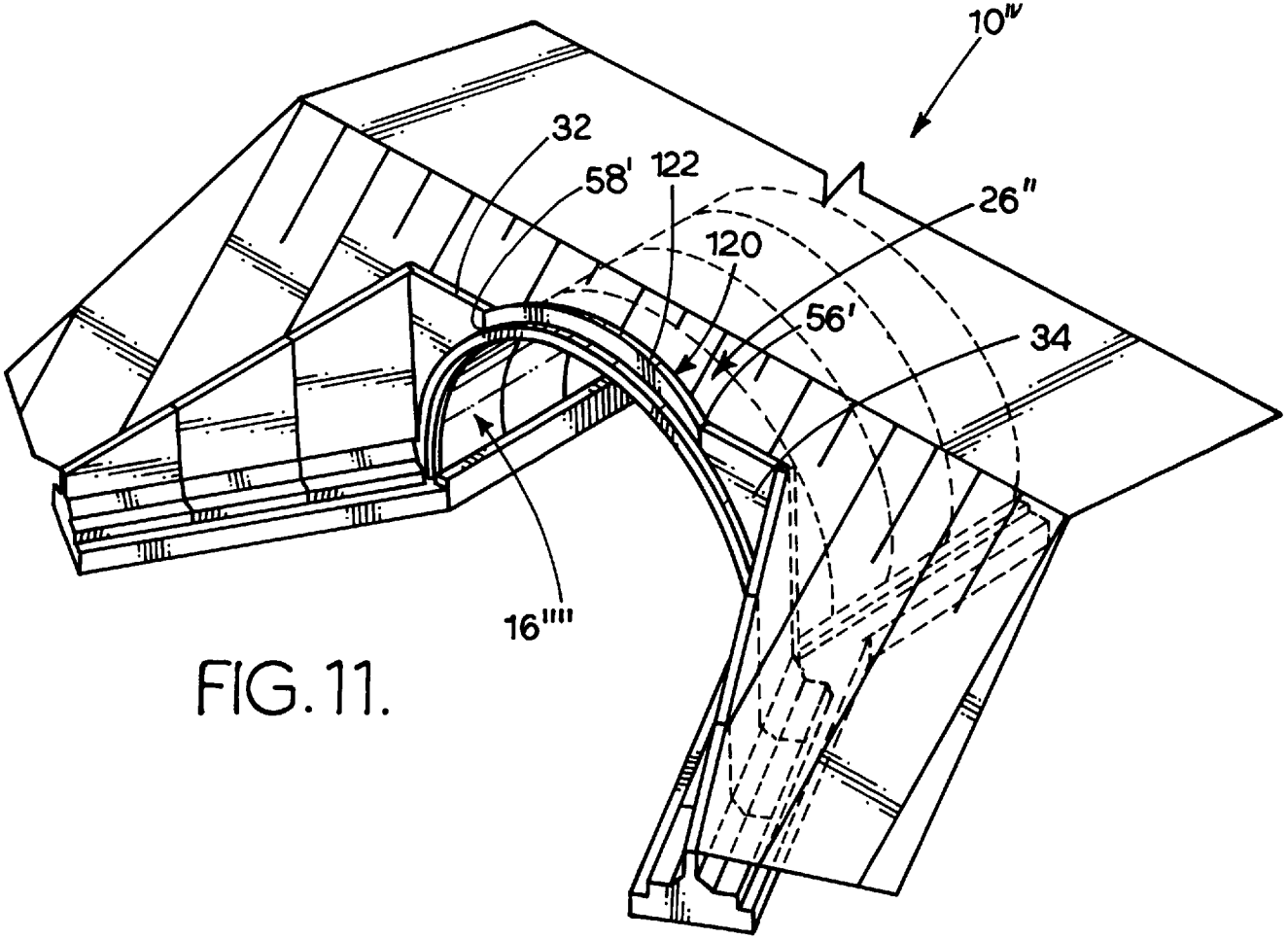
FIG. 11 is a perspective view of another form of the present invention for large arch heights.
Figure 14B:
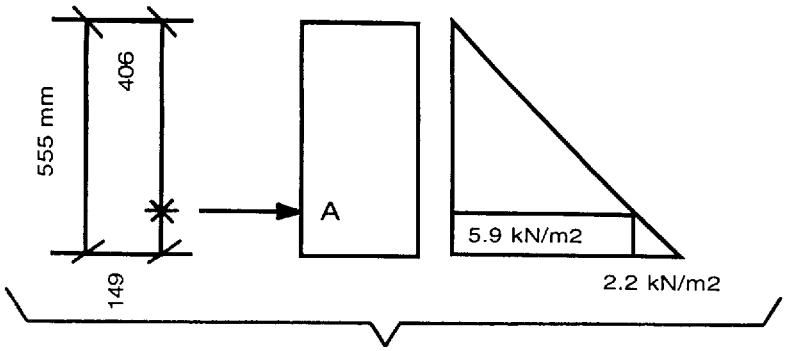
Figure 14C:
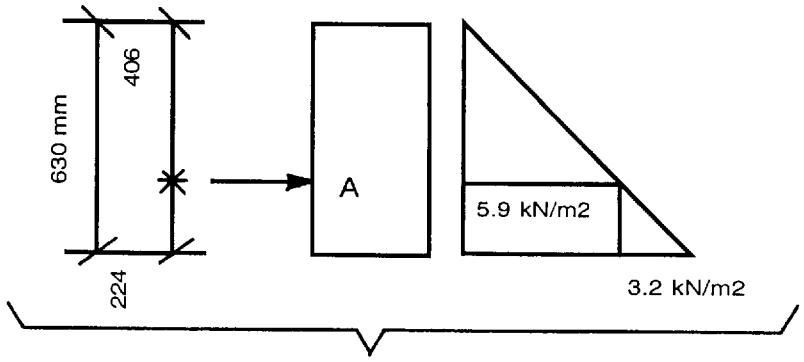
Figure 14D:
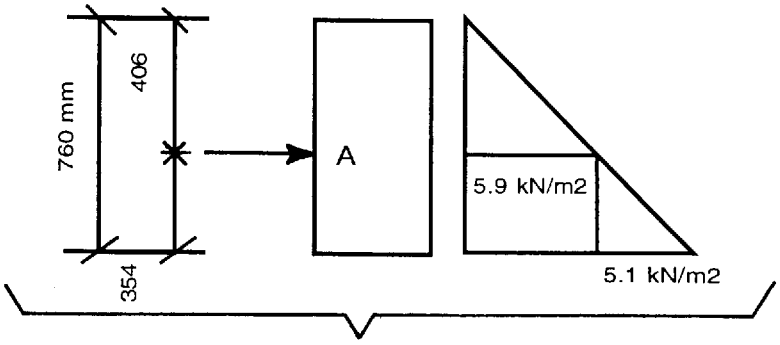
Figure 14E:
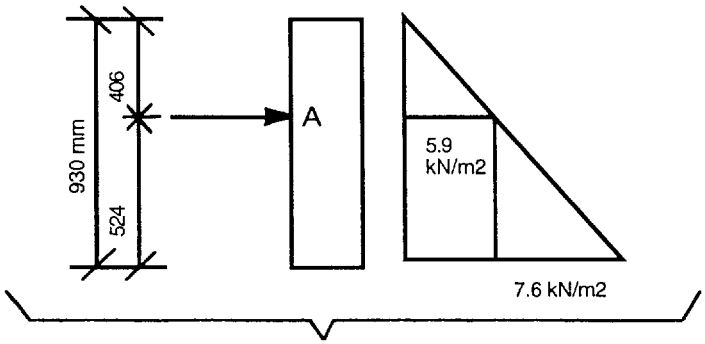
Figure 14F:
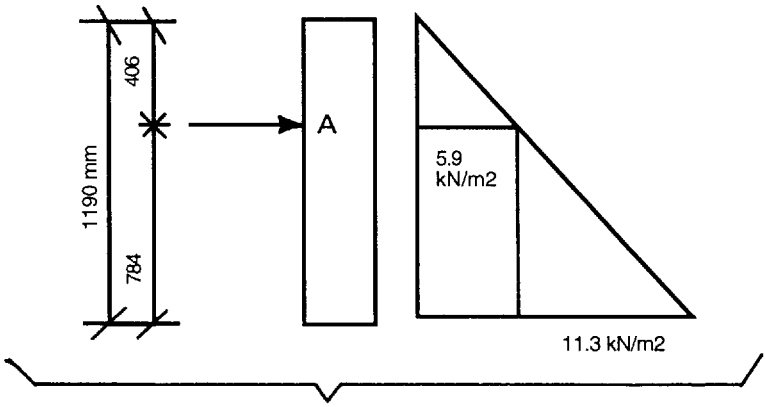
Figure 15A:
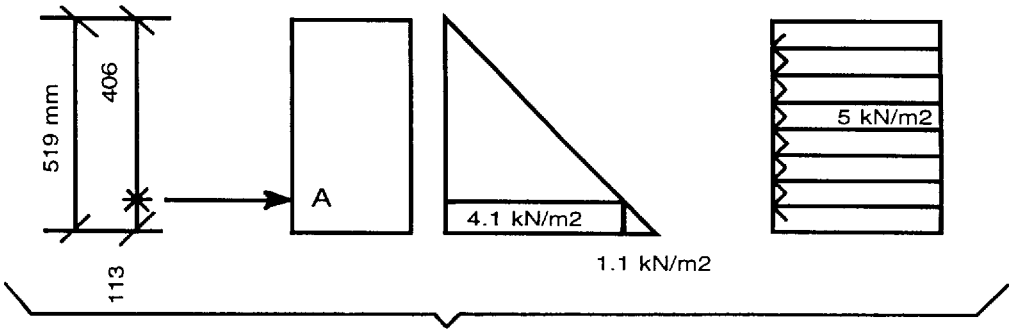
FIGS. 15A–15F illustrate the moments acting on each portion of the center segment under the second loadcase.
Figure 15B:
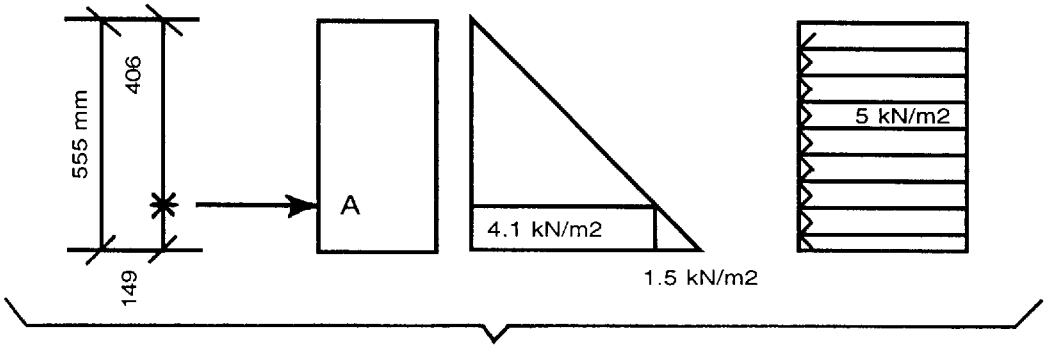
Figure 15C:
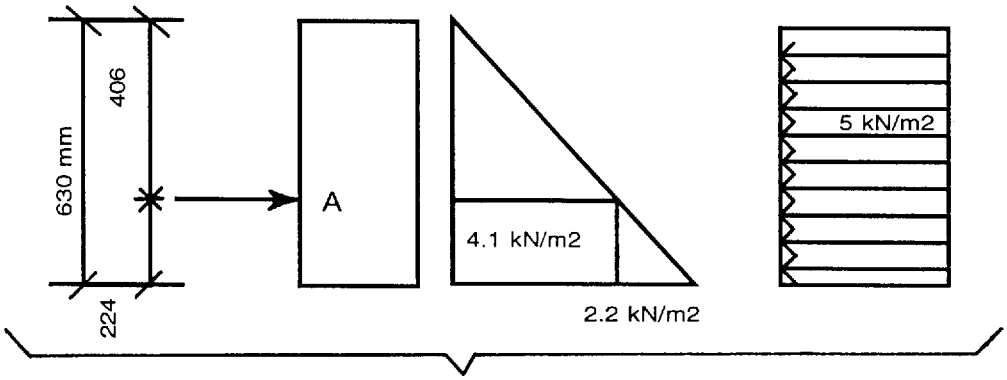
Figure 15D:
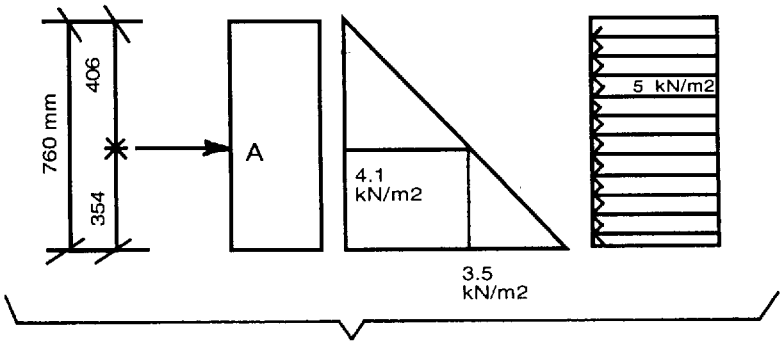
Figure 15E:
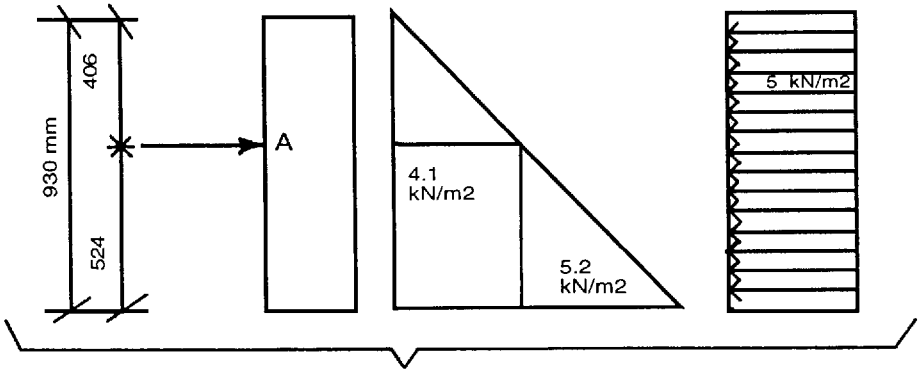
Figure 15F:
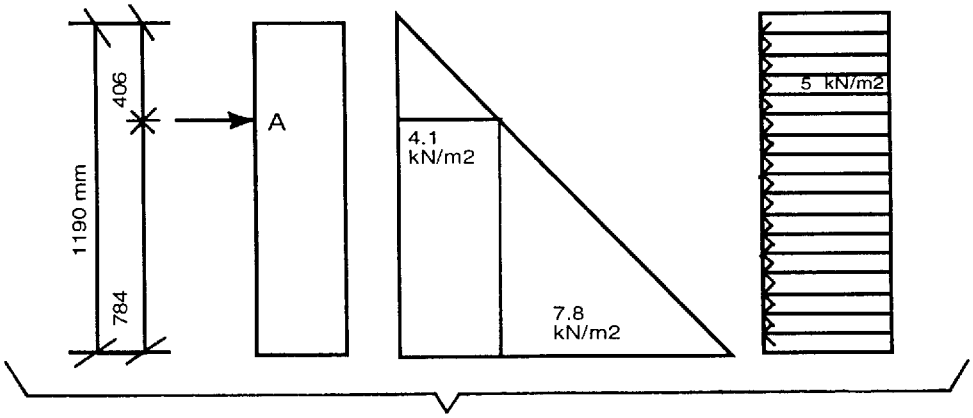

As can be seen in FIG. 3, top edges 60 and 72 of the segments of spandrel wall 26 are co-planar, and co-linear. However, there are certain situations, such as a very tall arch end element, in which this is not desirable. In those situations, the central segment of the spandrel wall can be modified as shown for central segment 120 in FIG. 11 for structure $\mathbf{10}^{IV}$. Segment 120 is identical in all respects to segment 30 described above, except that linear edge 60 of segment 30 is replaced by arcuate edge 122 on segment 120. Spandrel wall 26" on tall arch end element 16"" includes lateral segments 32 and 34 similar to the above-described lateral segments. Spandrel wall 26" is assembled and erected in a manner that is identical to that described above, and those skilled in the art will understand how this is effected therefore, such process will not be described. Structure $\mathbf{10}^{IV}$ can also include side-by-side structures in the manner shown in FIG. 10. It is noted that side-by-side structures of different arch shapes are also feasible; special joining segments must be prepared for this form of the invention.

As discussed above, the curb acts as horizontal support for the center segment and the lateral segments. The curb has a height H above the outer surface 40 of the arch element, with the outer surface extending for a substantial portion of the overall length of the arch element as can be seen in FIGS. 2–4. This height H is selected whereby the center segment will not overturn when it is supported on the arch element, without the need for ties. However, the curb need not be excessively high, and the precise height of the curb is selected as a balance between the competing factors of sufficient height and more height than is economical. FIGS. 12 through 15F illustrate how the center segment is stabilized by the backfill. FIG. 12 shows one half of the center segment. Since the center segment is bilaterally symmetric, only one half of the center segment is discussed. For the stability analysis, the segment is divided into sections 1–6. FIG. 12 also shows the overturning axis with the lowest safety factor for the center segment. In FIGS. 13A and 13B the two loadcases considered for the analysis can be seen. FIGS. 14A through 14F and 15A through 15F give the overturning and the retentive moments for each section relative to the overturning axis. Even though the overturning moments for sections 1 and 2 (and 3 for loadcase B) exceed the respective retentive moments, the center segment as a whole is stable, since the total of the retentive moments acting on Sections 1–6 is larger than the total of the overturning moments acting on these sections. Therefore, the height of the curb can be selected so that the overturning moment acting on the centermost section of the center segment is greater than the positive moment acting on this centermost section, with the positive moments acting on the outermost sections of the center segment more than offsetting this. A similar analysis shows that the net positive moment acting on the lateral segments more than offsets the overturning moments acting on those segments even though the curb has a height that is less than the height at which a centermost section of the center segment would have a net negative moment.

It is understood that while certain forms of the present invention have been illustrated and described herein, it is not to be limited to the specific forms or arrangements of parts described and shown.

I claim:

1. A combination of an arch element of an earth overfilled arch structure and a spandrel wall comprising:

A) an arch end element having an outer surface, two feet on the surface supporting said arch end element and an end edge extending from one foot to the other foot to have an overall length measured circumferentially around said arch end element end edge equal to the circumferential distance from one foot to the other, and a curb extending above said outer surface, said curb extending for more than one-half of said overall length;

B) a center segment resting on said arch end element and having a front surface abutting said curb;

C) a lateral segment which rests on said arch end element and has a front surface abutting said curb and an end edge abutting an end edge of said center segment;

D) the arch element providing vertical support for said segments with overfill and the curb providing all of the horizontal support for said center segment.

2. The combination defined in claim 1 wherein said segments are pre-cast concrete.

3. A monolithic arch element for an overfilled earth structure comprising a curved body, end edges on said body, an outer surface extending from one end edge to the other end edge for the entire length of said arch element, and a curb on said body at to one end edge and extending above said outer surface.

4. An overfilled structure comprising:

A) a monolithic arch element for an overfilled earth structure comprising a curved body, end edges on said body, two feet on means supporting said arch element, said end edges extending for the entire circumferential length of said curved body from one foot to the other and having an overall length measured circumferentially from one foot to the other, and a curb on said body adjacent to one end edge, said curb extending for at least one-half of said overall length;

B) a center segment resting on said arch element and having a front surface abutting said curb;

C) a lateral segment resting on said arch element and having a front surface abutting said curb; and D) means for supporting said segments including a vertical support and a horizontal support, the horizontal support for said center segment consisting entirely of said curb in abutting contact with the front surfaces of said center segment and overfill.

5. The overfilled structure defined in claim 4 further including means for stabilizing said segments.

6. The overfilled structure defined in claim 5 wherein said stabilizing means includes earth overfill adjacent to said segments.

7. The overfilled structure defined in claim 1 further including adhesive between said curb and said segments.

8. The overfilled structure defined in claim 1 further including a second lateral element.

9. A method of erecting an overfilled structure comprising:

A) placing a curb on an arch so that said arch includes ends and rests on two feet on supporting means and each of the ends has an overall length extending circumferentially from one foot to the other foot and having the curb extend for at least one-half of the overall length;

B) positioning the arch element to have the feet resting on the supporting means;

C) placing one segment of a spandrel wall on the arch element;

D) placing a second segment of the spandrel wall on the arch element;

E) positioning each segment so a surface thereof is in abutting contact with the curb on the arch element;

F) using overfill and the abutting contact between the curb and the one segment as the sole horizontal support for the one segment; and G) stabilizing the segments.

10. The method defined in claim 9 including placing a third segment of the spandrel wall on the arch element.

11. The method defined in claim 10 further including a step of forming the second and third segments to be mirror images of each other.

12. The method defined in claim 9 wherein the step of stabilizing the segments includes backfilling earth on the arch element adjacent to the segments after they are placed on the arch element.

13. The method defined in claim 9 further including a wingwall and wherein the step of stabilizing the segments includes placing the second segment in abutting contact with the wingwall.

14. The method defined in claim 9 wherein the step of stabilizing the segments includes backfilling earth on the arch element adjacent to the segments after they are placed on the arch element wherein vertical support for each of the segments is provided by the arch element and horizontal support is provided solely by the curb and stabilization is provided by the earth backfilled adjacent to the segments.

15. The method defined in claim 12 further including using adhesive to adhere the segments to the curb prior to the backfilling step.

16. The method defined in claim 9 wherein each of the segments has end edges and the segments are placed so the end edge of the one segment is in abutting contact with the end edge of the second segment.

17. The method defined in claim 9 further including using the arch element as the sole vertical support for the one segment.

18. A combination of an arch end element of an earth overfilled arch structure and a spandrel wall comprising:

A) an arch end element having an outer surface, two feet resting on means for supporting said arch element, an end edge which extends from one foot to the other and has an overall length measured circumferentially along the end edge from one foot to the other foot, and a curb on said arch end element adjacent to said one end and extending upward above said outer surface for at least one-half of said overall length;

B) a center segment resting on said arch end element and having a front surface abutting said curb;

C) a lateral segment which rests on said arch end element and has a front surface abutting said curb and an end edge abutting an end edge of said center segment;

D) wherein said arch end element provides vertical support for said segments and said curb provides horizontal support for said segments, with said curb and overfill providing all of the horizontal support for said center segment.

19. The combination defined in claim 18 wherein said center segment is bilaterally symmetric and is vertically supported solely by said arch element.

20. The combination defined in claim 18 wherein said center segment includes a curved side and three linear sides, and includes a centermost section, said center segment having a width defined between said curved side and one of said linear sides, the width of said center segment being the smallest at said centermost section.

21. A spandrel wall for an overfilled earth structure comprising:

A) a center segment resting entirely on an arch element and having a front surface abutting a curb on the arch element with vertical support for said center segment consisting entirely of the arch element, said curb extending for at least one-half of the circumferential length of said arch element; and B) two lateral segments each of lateral segment which rests on the arch element and has a front surface abutting the curb and an end edge abutting an end edge of said center segment.

22. The spandrel wall defined in claim 21 wherein said lateral segments are L-shaped.

23. The spandrel wall defined in claim 21 further including means for coupling said center segment to each of said lateral segments.

24. The spandrel wall defined in claim 21 wherein said center segment includes a top edge and each of said lateral segments includes a top edge with all of said top edges being co-planar with each other.

25. The spandrel wall defined in claim 21 wherein said center segment includes an arcuate top edge and each of said lateral segments includes a planar top edge.

26. The spandrel wall defined in claim 5 wherein said coupling means includes a projection element on the edge of one segment and a groove on the edge of an adjacent segment for receiving said projection element.

27. The spandrel wall defined in claim 21 further including a wingwall abutting each of said lateral segments.

28. The combination of claim 27 further including means for stabilizing said segments; said stabilizing means includes earth overfill adjacent to said center segment.

29. The combination defined in claim 21 wherein one surface of said curb forms an end edge of said arch element.

* * * * *